US009430994B2

(12) United States Patent
Vogt

(10) Patent No.: US 9,430,994 B2
(45) Date of Patent: Aug. 30, 2016

(54) GUITAR NECK JOINT

(71) Applicant: Paul Edward Vogt, Kings Mountain, NC (US)

(72) Inventor: Paul Edward Vogt, Kings Mountain, NC (US)

( * ) Notice: Subject to any disclaimer, the term of this patent is extended or adjusted under 35 U.S.C. 154(b) by 0 days.

(21) Appl. No.: 14/700,907

(22) Filed: Apr. 30, 2015

(65) Prior Publication Data

US 2015/0317959 A1 Nov. 5, 2015

Related U.S. Application Data

(60) Provisional application No. 61/986,540, filed on Apr. 30, 2014.

(51) Int. Cl.

| | |
|---|---|
| ***G10D 3/00*** | (2006.01) |
| ***G10D 1/08*** | (2006.01) |
| ***G10D 3/06*** | (2006.01) |

(52) U.S. Cl.

CPC . *G10D 1/08* (2013.01); *G10D 3/06* (2013.01)

(58) Field of Classification Search

USPC ..... 84/293

See application file for complete search history.

(56) References Cited

U.S. PATENT DOCUMENTS

| | | | | |
|---|---|---|---|---|
| 5,452,637 | A * | 9/1995 | DeCola | G10D 3/06 84/267 |
| 6,198,030 | B1 * | 3/2001 | Rose | G10H 1/44 84/290 |
| 7,081,575 | B1 * | 7/2006 | Pieper, Jr. | G10D 3/06 84/267 |
| 7,687,698 | B2 * | 3/2010 | Kim | G10D 3/06 84/267 |
| 8,558,096 | B2 * | 10/2013 | Altheim | G10D 3/06 84/293 |
| 8,957,291 | B1 * | 2/2015 | Nelson | 84/291 |
| 2014/0352517 | A1 * | 12/2014 | Zeren | G10D 1/08 84/293 |

* cited by examiner

*Primary Examiner* — Christopher Uhlir

(57) ABSTRACT

A neck joint for guitars providing a secure joint with tight mechanical bonding that can be removable and maintainable. It is configurable so that it is adjustable in two directions to accommodate variations in string height and neck angle.

3 Claims, 4 Drawing Sheets

GUITAR NECK JOINT

APPLICATION CROSS-REFERENCE(S)

This application claims the benefit of U.S. Provisional Application No. 61/986,540 filed Apr. 30, 2014.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON COMPACT DISC

Not Applicable.

BRIEF DESCRIPTION OF THE FIGURES

The present invention is illustrated by way of example, and not limitation, in the figures of the accompanying drawings in which like references indicate similar elements.

DETAILED DESCRIPTION

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present invention is not limited to the embodiments shown, but is to be accorded the widest scope consistent with the principles and features disclosed herein.

In one embodiment a guitar neck joint comprises a tenon with features that locate the tenon relative to a mortised area in the guitar body and wedges that provide force in two substantially perpendicular directions that serve to precisely attach the neck to the guitar body without the need for adhesives or other additional bonding agents. The mortised area may be a full or partial mortise.

This type of neck joint provides the benefits associated with a tenon, long-tenon or through-body neck joint while retaining the serviceability of a bolt-on neck. It also facilitates precision adjustments to the neck angle or string height while providing a tight mechanical fit.

When maintainability or serviceability is not required in a particular design or application, the guitar neck joint can also be used with adhesive or bonding agents to permanently affix the neck to the body. In an embodiment that uses adhesive or bonding agents the joint provides precision adjustments to the neck angle or string height while providing a tight mechanical fit prior to setting of the adhesive or bonding agent.

Figure 1:
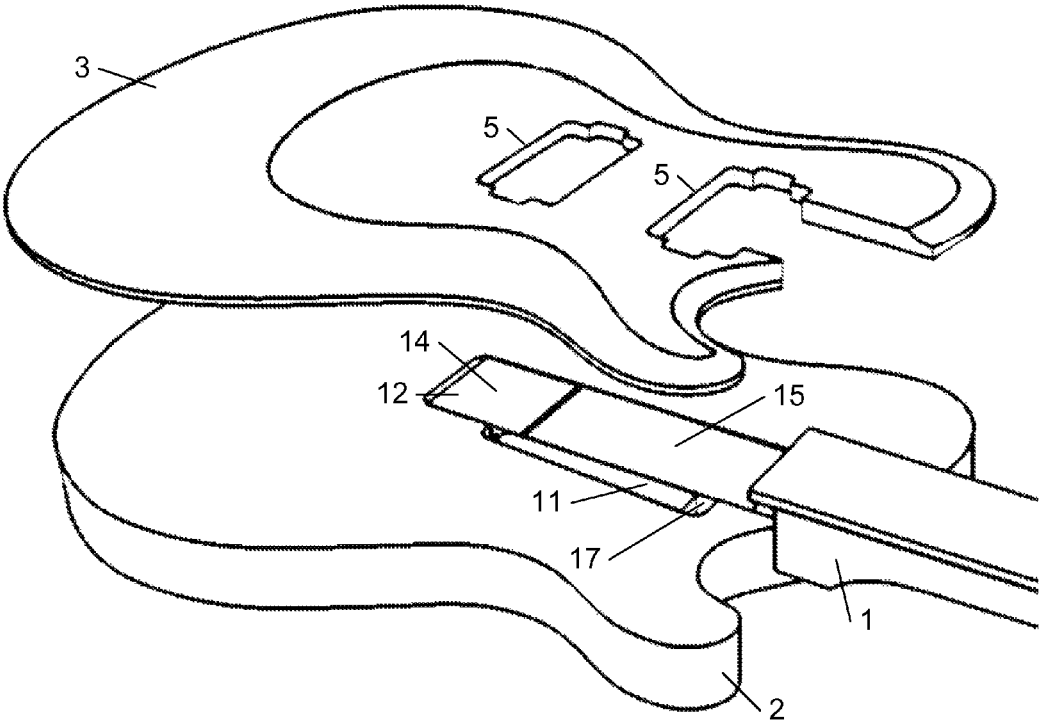
FIG. 1 shows a partially exploded view revealing the details of a neck joint in accordance with an embodiment.
Figure 2:
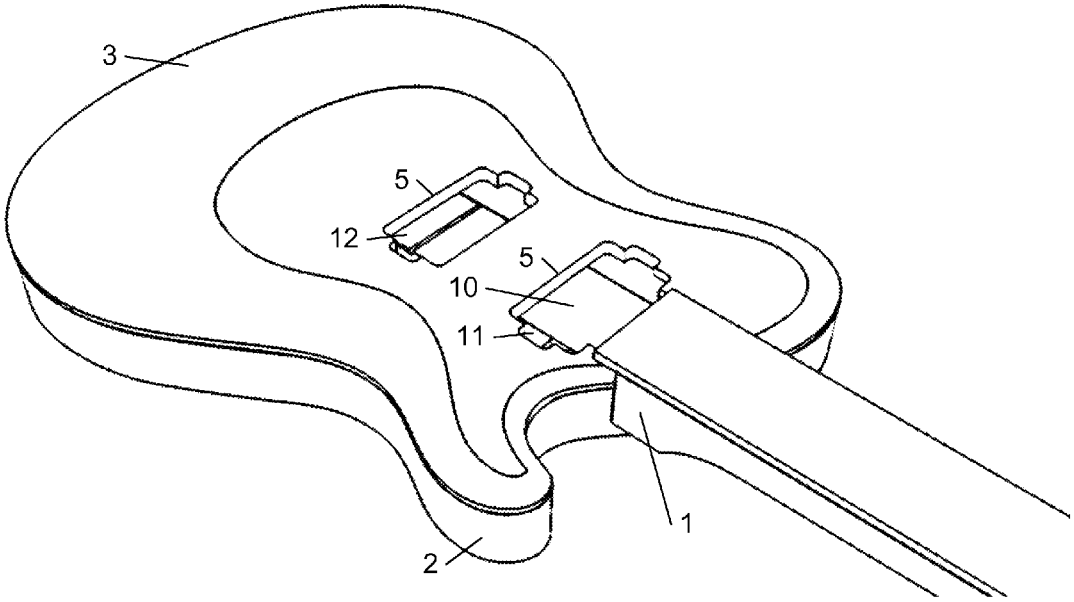
FIG. 2 shows a guitar neck with a tenon seated in a mortise in a solid-body guitar in accordance with an embodiment.
Figure 3:
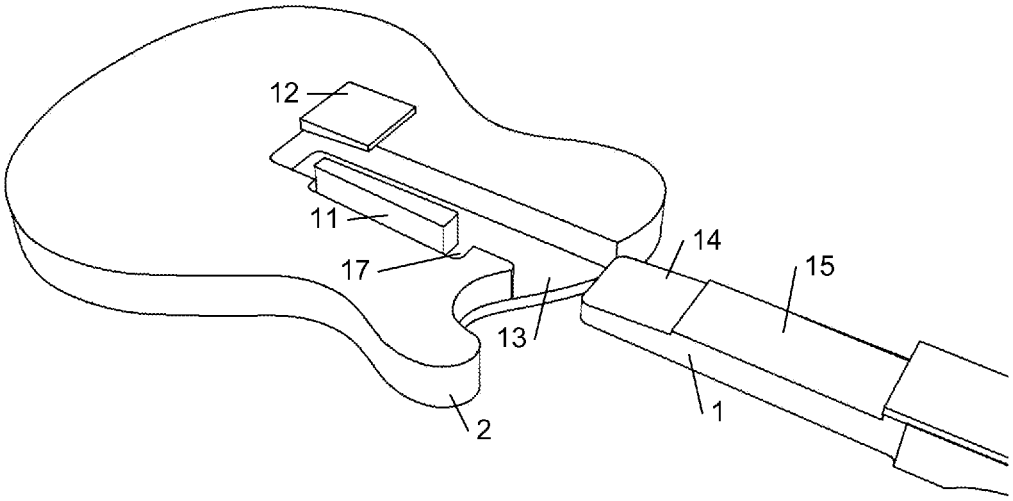
FIG. 3 shows an exploded view, without a top, revealing the details of a neck joint in accordance with an embodiment.
Figure 4:
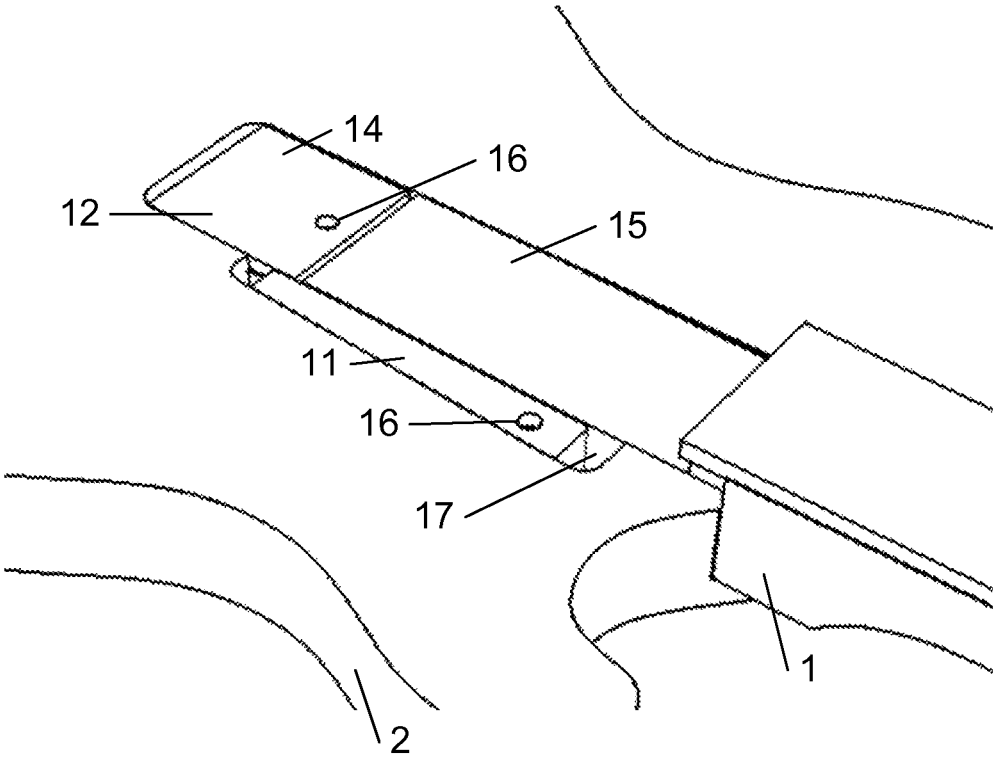
FIG. 4 shows a view revealing the details of a neck joint in accordance with an embodiment.

This embodiment is shown in FIGS. 1, 2, 3, & 4 where the locating features are the boundaries of the neck 1 tenon and mortised area 13 in the body 2. In this embodiment the lateral mating force between the neck 1 and body 2 is provided by a wedge 11. The side of the neck in contact with the wedge 11 is shaped so that the angle of the wedge 11 in combination with the angle of the opposing wall of pocket 17 provides a secure fit. The perpendicular force between the neck 1 and body 2 is also provided by a wedge 12. The mating surface 14 on the neck 1 is shaped so that the angle of the wedge 11 provides a secure fit.

Because of the wedge 12, this embodiment requires that the mortise is a full mortise that would typically be provided by top 3. In order to seat the wedges in this embodiment the wedges 11, 12 are accessed through the pick-up holes 5 in the top 3. In this, and other, embodiments the wedges 8, 11, 12 may have features 16 that allow a tool to transfer a tapping force to seat the wedges 8, 11, 12 during assembly or unseat the wedges during disassembly. The location of these features 16 is not critical. Some embodiments may omit this feature 16 and use a tool with a point to penetrate the wedge 8, 11, 12 material to transfer the tapping force used to seat the wedge 8, 11, 12.

What is claimed is:

1. A system for attaching a neck to a body of a guitar, comprising:

a top with one or more holes; and a body, attached to said top, having a milled portion forming a mortised area in combination with said top, said mortised area shaped so as to provide an additional pocketed area to one side where said pocketed area is shaped so that one side of the pocketed area is open to the mortised area and another side is angled with respect to the opposing side of said mortised area so that they are not parallel; and a neck shaped so as to form tenon on one end where said tenon is shaped so as to be accepted into said mortised area where the neck is then inserted into said mortised area; and a first wedge placed into said pocketed area so that it is in contact with one side of the pocketed area and is also in contact with said tenon and can be accessed through a corresponding hole in said top, so a driving force applied to the first wedge will force the tenon against said opposing side of said mortised area; and a second wedge placed between said top and said tenon so that it is in contact with said top and said tenon and can also be accessed through a corresponding hole in said top, so a driving force applied to the second wedge will force the tenon against a side of said mortised area opposite to the top.

2. An attachment system according to claim 1, wherein said first and second wedges have milled features to facilitate the application of a driving force.

3. An attachment system according to claim 1, wherein a bonding agent is applied to at least said tenon to permanently affix the neck to the body after driving forces are applied to said first and second wedges.

* * * * *